US006642817B2

(12) United States Patent
Kuroda et al.

(10) Patent No.: US 6,642,817 B2
(45) Date of Patent: Nov. 4, 2003

(54) DIELECTRIC FILTER, DIELECTRIC DUPLEXER, AND COMMUNICATION DEVICE

(75) Inventors: Katsuhito Kuroda, Matsutou (JP); Hirofumi Miyamoto, Kanazawa (JP); Jinsei Ishihara, Kanazawa (JP); Hideyuki Kato, Ishikawa-gun (JP)

(73) Assignee: Murata Manufacturing Co. Ltd (JP)

( * ) Notice: Subject to any disclaimer, the term of this patent is extended or adjusted under 35 U.S.C. 154(b) by 39 days.

(21) Appl. No.: 10/076,724

(22) Filed: Feb. 13, 2002

(65) Prior Publication Data

US 2002/0109567 A1 Aug. 15, 2002

(30) Foreign Application Priority Data

Feb. 14, 2001 (JP) ..... 2001-036968

(51) Int. Cl.[7] ..... H01P 1/205; H01P 1/213
(52) U.S. Cl. ..... 333/206; 333/134
(58) Field of Search ..... 333/202, 206, 333/207, 134

(56) References Cited

U.S. PATENT DOCUMENTS 5,949,308 A * 9/1999 Hino ..... 333/202
6,052,040 A * 4/2000 Hino ..... 333/134
6,069,542 A * 5/2000 Matsumoto et al. ..... 333/202
2002/0021189 A1 * 2/2002 Kuroda et al. ..... 333/134

FOREIGN PATENT DOCUMENTS

EP 0982792 A2 * 3/2000
EP 1030400 A1 * 8/2000
JP 04095401 A * 3/1992
JP 05-145302 6/1993

* cited by examiner

*Primary Examiner*—Seungsook Ham
(74) *Attorney, Agent, or Firm*—Dickstein, Shapiro, Morin & Oshinsky LLP.

(57) ABSTRACT

A dielectric filter which has suitable attenuation characteristics and which readily exhibits desired characteristics. First, second and third inner-conductor holes having an inner conductor on each of the surfaces thereof are formed inside a dielectric block having an outer conductor on the outer surface thereof. First and second I/O electrodes extend from opposing side-surfaces to the undersurface of the dielectric block and are separated from the outer conductor. The side-surfaces are orthogonal to the direction in which the inner-conductor holes are arrayed in the dielectric block, and the undersurface is a mounting surface for facing a mounting board. The first I/O electrode extends from one of said side-surfaces near the first inner-conductor hole, to a position beyond a remote side of the second inner-conductor hole, that is, the side near the third inner-conductor hole.

14 Claims, 7 Drawing Sheets

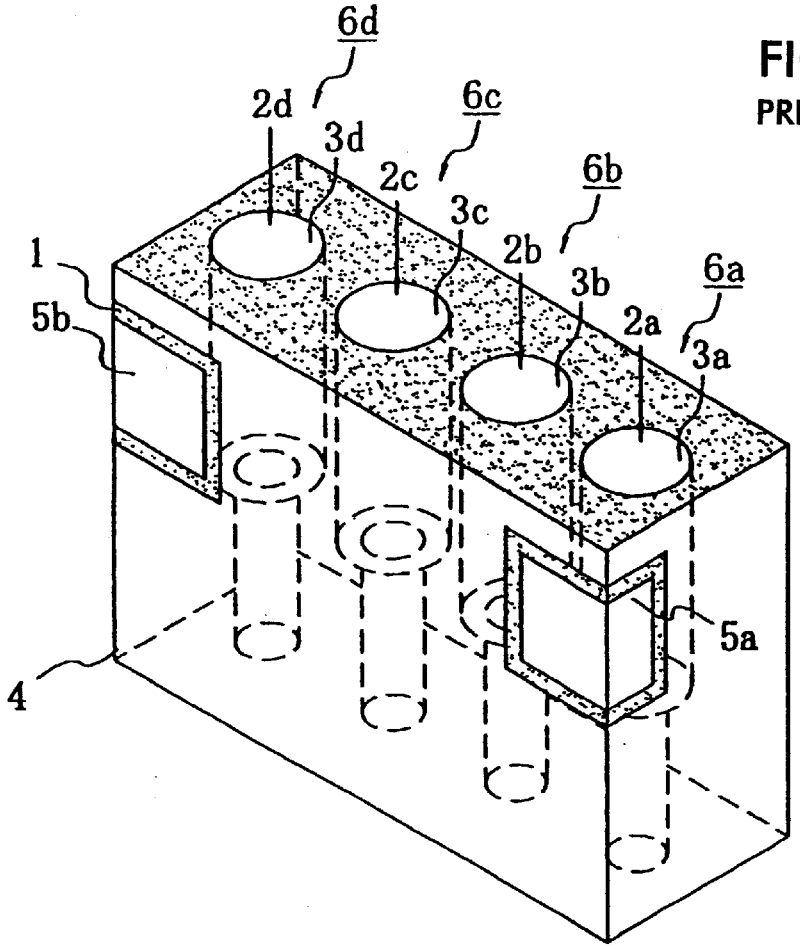
FIG. 7A
PRIOR ART
FIG. 7B PRIOR ART
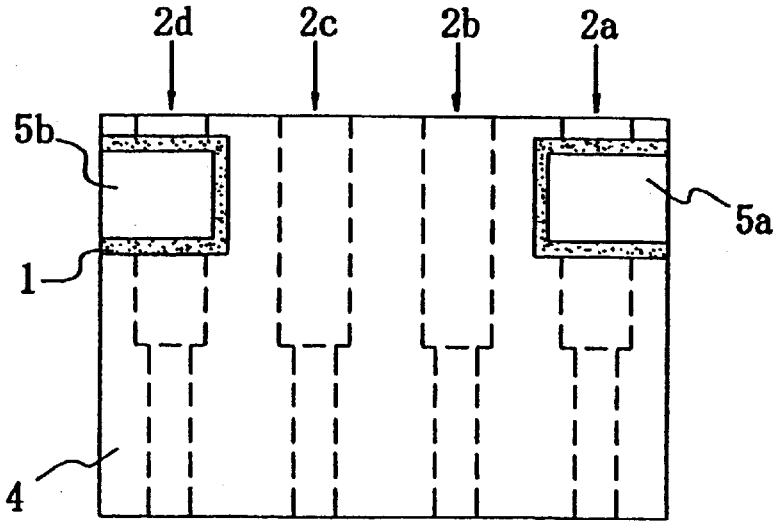

DIELECTRIC FILTER, DIELECTRIC DUPLEXER, AND COMMUNICATION DEVICE

BACKGROUND OF THE INVENTION

1. Field of the Invention

The present invention relates to a dielectric filter and a dielectric duplexer which comprise a dielectric block having holes with conductors formed on the surfaces of the holes (hereinafter referred to as inner-conductor holes) and an outer conductor on the outer surface of the dielectric block, and to a communication device using the dielectric filter and the dielectric duplexer.

2. Description of the Related Art

A known dielectric filter having a substantially rectangular parallelepiped dielectric block will now be described with reference to FIGS. 7A and 7B.

FIG. 7A is a perspective view of the dielectric filter, and FIG. 7B is a leftside elevational view of the same.

In FIGS. 7A and 7B, the dielectric filter includes a dielectric block 1, inner-conductor holes 2*a*, 2*b*, 2*c*, and 2*d*, inner conductors 3*a*, 3*b*, 3*c*, and 3*d*, an outer conductor 4, input and output (I/O) electrodes 5*a* and 5*b*, and dielectric resonators 6*a*, 6*b*, 6*c*, and 6*d*.

Inside the dielectric block 1, the inner-conductor holes 2*a* to 2*d*, which have the inner conductors 3*a* to 3*c* on the surfaces thereof, form resonators. On the outer surface of the dielectric block 1, the outer conductor 4 forms a ground electrode. In this manner, the inner-conductor holes 2*a* to 2*d* and the outer conductor 4 form the dielectric resonators 6*a* to 6*d*. On the outer surface of the dielectric block 1, the I/O electrode 5*a* is formed separate from the outer conductor 4 and is coupled with the dielectric resonator 6*a* (hereinafter referred to as the resonator), and the I/O electrode 5*b* is formed separate from the outer conductor 4 and is coupled with the resonator 6*d*, whereby the dielectric filter is formed.

However, dielectric filters using the known dielectric blocks have the problems described below.

Generally, bandpass filters must obtain a predetermined attenuation far outside the pass band. To this end, an attenuation pole is provided in the attenuation region of the bandpass filters.

In the known dielectric filter, the I/O electrode 5*a* is coupled with the resonator 6*a* and the I/O electrode 5*b* is coupled with the resonator 6*d*. Since the amount of coupling between the resonator 6*a* and the resonator 6*b*, and between the resonator 6*c* and the resonator 6*d* is small, the resonators are not sufficiently capacitively coupled. Therefore, an effective attenuation pole is not obtained. To obtain a sufficient amount of coupling, a capacitor must be provided between the resonator 6*a* and the resonator 6*b*, and between the resonator 6*c* and the resonator 6*d*. Accordingly, the manufacturing costs increase due to the increase in the number of parts, and the reliability deteriorates because of the increase in the number of connections.

In Japanese Unexamined Patent Application Publication No. 5-145302, a dielectric filter in which an attenuation pole is provided in the vicinity of the pass band thereof is disclosed.

The dielectric filter comprises a dielectric block having a plurality of dielectric resonators. The dielectric block has I/O electrodes on the outer surface thereof, which are coupled with the plurality of dielectric resonators. According to this configuration, since the amount of coupling between the plurality of resonators and between the plurality of resonators and the I/O electrodes becomes large, the attenuation region is provided with a pole, making the attenuation curve steeper by forming an attenuation pole near the pass band. Thus, a bandpass filter capable of sufficiently attenuating unwanted signals is provided.

In the above-described dielectric filter, however, the size of the I/O electrodes may vary according to manufacturing tolerances. In such a case, the amount of coupling between the second resonator and the I/O electrode varies, rendering the attenuation characteristics unstable.

Also, when the width of the I/O electrodes (the dimension of the I/O electrodes parallel to the axes of the inner-conductor holes) is large, the Qo factor of the resonators deteriorates, and the insertion loss increases. Further, since the width of the I/O electrodes is fixed, a dielectric filter formed in a certain shape exhibits only one kind of attenuation characteristic. In other words, the dielectric filter is not capable of exhibiting a plurality of attenuation characteristics for achieving desired characteristics.

SUMMARY OF THE INVENTION

Accordingly, the present invention provides a dielectric filter and a dielectric duplexer, which exhibit suitable attenuation characteristics and which readily obtain desired characteristics, and provides a communication device using the dielectric filter and the dielectric duplexer.

To this end, according to an aspect of the present invention, there is provided a dielectric filter comprising a substantially rectangular parallelepiped dielectric block, a plurality of inner-conductor holes extending from a first main surface to an opposing second main surface of the dielectric block, an inner conductor provided on the surface of each of the inner-conductor holes, an outer conductor formed on outer surfaces of the dielectric block, and I/O electrodes extending from side-surfaces to an undersurface of the dielectric block. The side-surfaces are orthogonal to the direction in which the inner-conductor holes are arrayed in the dielectric block, and the undersurface is a mounting surface for facing a mounting board. The I/O electrodes are separated from the outer conductor. Further, at least one of the I/O electrodes extends across portions of the undersurface of the dielectric block adjacent to at least two of the inner-conductor holes when viewed from the undersurface. The dielectric filter obtained according to this configuration exhibits stable and suitable attenuation characteristics.

In one form of the invention, the width of the one of the I/O electrodes is different between a first region corresponding to the first inner-conductor hole and a second region corresponding to the second inner-conductor hole when viewed from the undersurface. According to this configuration, a dielectric filter is obtained, which readily obtains desired attenuation characteristics.

The width at the first region may be larger than the width at the second region. According to this configuration, a dielectric filter is obtained, which readily obtains desired attenuation characteristics.

The width at the first region may be smaller than the width at the second region. According to this configuration as well, a dielectric filter is obtained, which readily obtains desired attenuation characteristics.

According to another aspect of the present invention, there is provided a dielectric duplexer comprising the dielectric filter. According to this configuration, the dielectric duplexer exhibits desired characteristics, and stable and suitable attenuation characteristics are achieved.

According to another aspect of the present invention, there is provided a communication device comprising the dielectric filter. According to this configuration, the communication device exhibits suitable communication characteristics.

Other features and advantages of the present invention will become apparent from the following description of embodiments of the invention which refers to the accompanying drawings.

BRIEF DESCRIPTION OF THE DRAWINGS

FIG. 7A is a perspective view of a known dielectric filter; and

FIG. 7B is an elevational view of the known dielectric filter.

DESCRIPTION OF EMBODIMENTS OF THE INVENTION

Figure 1A:
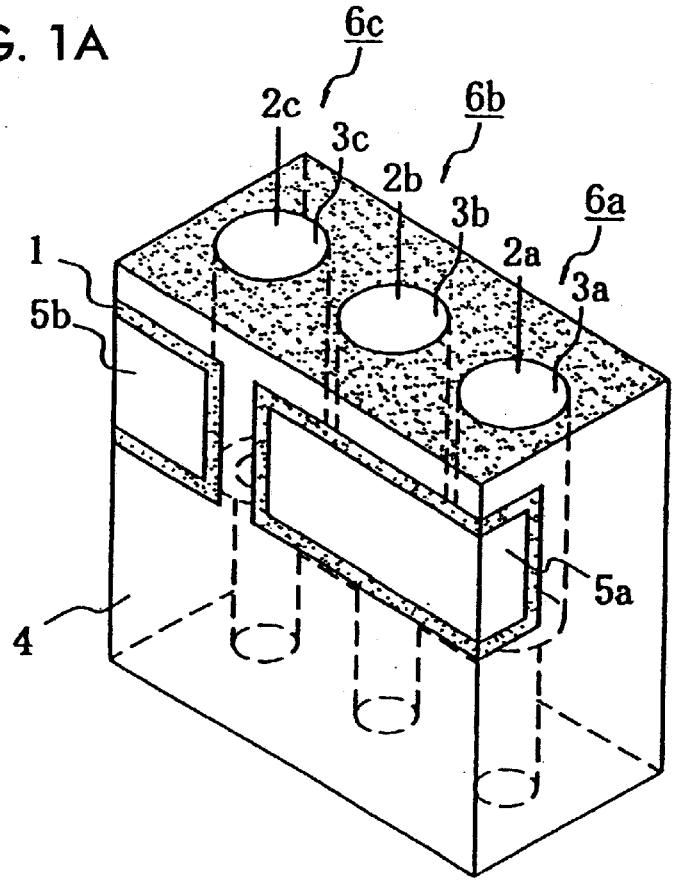
FIG. 1A is a perspective view of a dielectric filter according to a first embodiment.

It is to be noted that like parts are designated by like reference numerals throughout the accompanying drawings. With reference to FIGS. 1A and 1B and FIGS. 2A and 2B, a dielectric filter according to a first embodiment will now be described.

Figure 1B:
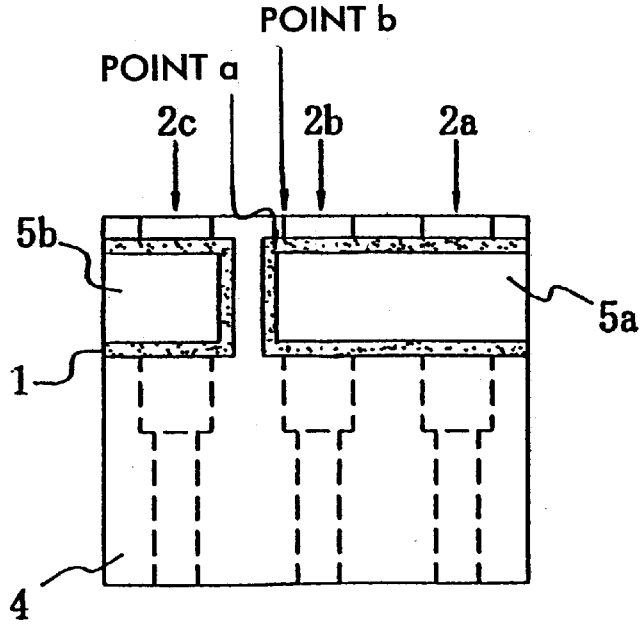
FIG. 1B is an elevational view of the dielectric filter according to the first embodiment.

FIG. 1A is a perspective view of the dielectric filter, and FIG. 1B is an elevational view of the same.

In FIGS. 1A and 1B, the dielectric filter includes a dielectric block 1, inner-conductor holes 2*a*, 2*b* and 2*c*, inner conductors 3*a*, 3*b* and 3*c*, an outer conductor 4, input and output (I/O) electrodes 5*a* and 5*b*, and dielectric resonators (hereinafter referred to as resonators) 6*a*, 6*b* and 6*c*.

Inside the dielectric block 1, the inner-conductor holes 2*a* to 2*c*, which have the inner conductors 3*a* to 3*c* formed on the surfaces thereof, form resonators. On the outer surface of the dielectric block 1, the outer conductor 4 is formed as a ground electrode. The inner-conductor holes 2*a* to 2*c* and the outer electrode 4 constitute the resonators 6*a* to 6*c*. The I/O electrode 5*a* extends from one side-surface to the undersurface of the dielectric block 1 and is separated from the outer conductor 4. The side-surfaces are orthogonal to the direction in which the inner-conductor holes are arrayed, and the undersurface is the surface shown in FIG. 1A when viewed from the left side, which faces a mounting board (not shown) when the dielectric filter is mounted. The I/O electrode 5*b* extends from the other side-surface to the undersurface of the dielectric block 1 and is separated from the outer conductor 4.

As shown in FIG. 1B, the I/O electrode 5*a* on the undersurface extends to a point a that is beyond a point b corresponding to the side of the inner-conductor hole 2*b* near the inner-conductor hole 2*c*.

Further, in this embodiment, the resonators 6*a* to 6*c* are aligned so that the resonator 6*b* is positioned to the left of the resonator 6*a*, and the resonator 6*c* is positioned to the left of the resonator 6*b* when viewed from the undersurface.

Hence, the I/O electrode 5*a* is coupled with the inner-conductor holes 2*a* and 2*b*. It also means that the I/O electrode 5*a* is coupled with the resonators 6*a* and 6*b*.

Figure 2A:
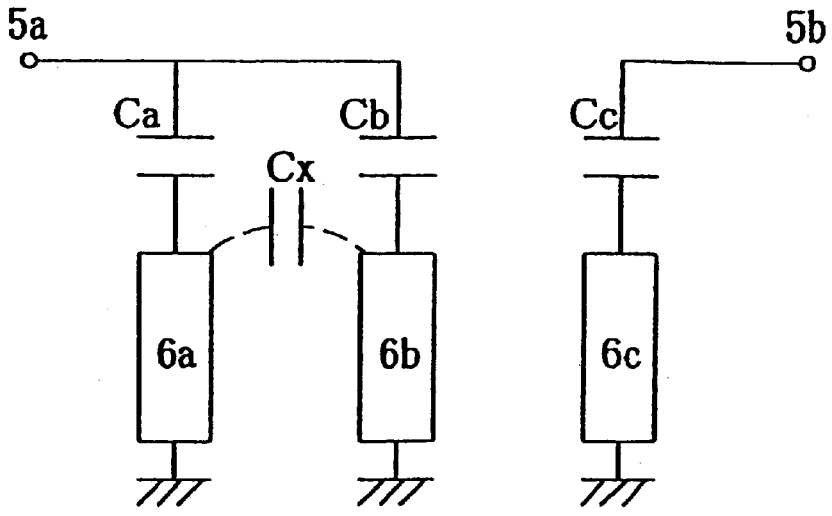
FIG. 2A is an equivalent circuit diagram of the dielectric filter according to the first embodiment.
Figure 2B:
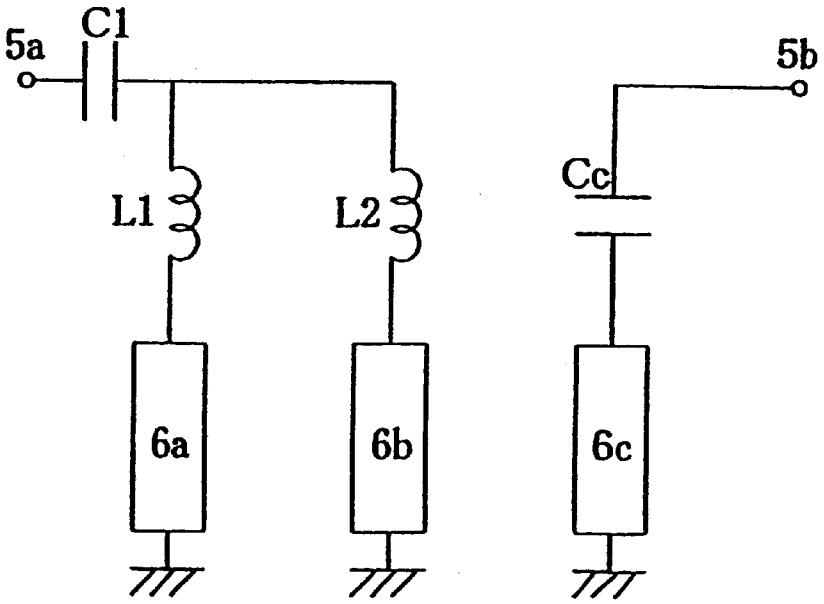
FIG. 2B is an equivalent circuit diagram of the dielectric filter according to the first embodiment.

FIG. 2A shows an equivalent circuit diagram of the dielectric filter shown in FIGS. 1A and 1B. FIG. 2B shows an equivalent circuit diagram obtained by converting the equivalent circuit shown in FIG. 2A.

In FIGS. 2A and 2B, reference numerals 5*a* and 5*b* denote the I/O electrodes of the dielectric filter, and reference numerals 6*a*, 6*b* and 6*c* denote the resonators. Further, reference numerals Ca, Cb, Cc, Cx, and C1 denote capacitances, and reference numerals L1 and L2 denote inductances.

As shown in FIG. 2A, the capacitance Ca connects the I/O electrode 5*a* with the resonator 6*a*, and the capacitance Cb connects the I/O electrode 5*a* with the resonator 6*b*. Further, the capacitance Cx connects the resonator 6*a* and the resonator 6*b*, and the capacitance Cc connects the I/O electrode 5*b* with the resonator 6*c*.

Since the circuit shown in FIG. 2A is a closed, D-shaped circuit comprising the three capacitances Ca, Cb and Cx, the circuit may be considered equivalent to a Y-shaped circuit as shown in FIG. 2B. A series resonance is generated by the resonator 6*a* and the inductor L1, whereby an attenuation pole is formed at a high frequency of the pass band.

Since the I/O electrode 5*a* extends beyond the position corresponding to one side of the resonator 6*b*, that is, the end near the resonator 6*c*, the capacitance Cb becomes stable even when dimensional variations occur. Therefore, an attenuation pole is formed stably. Since the capacitance Cb is provided without enlarging the width of the I/O electrode 5*a*, deterioration of the Qo factor and insertion loss is reduced.

Hence, the dielectric filter exhibits stable and suitable attenuation characteristics.

Next, a dielectric filter according to a second embodiment will now be described with reference to FIGS. 3A and 3B and FIGS. 4A and 4B.

Figure 3A:
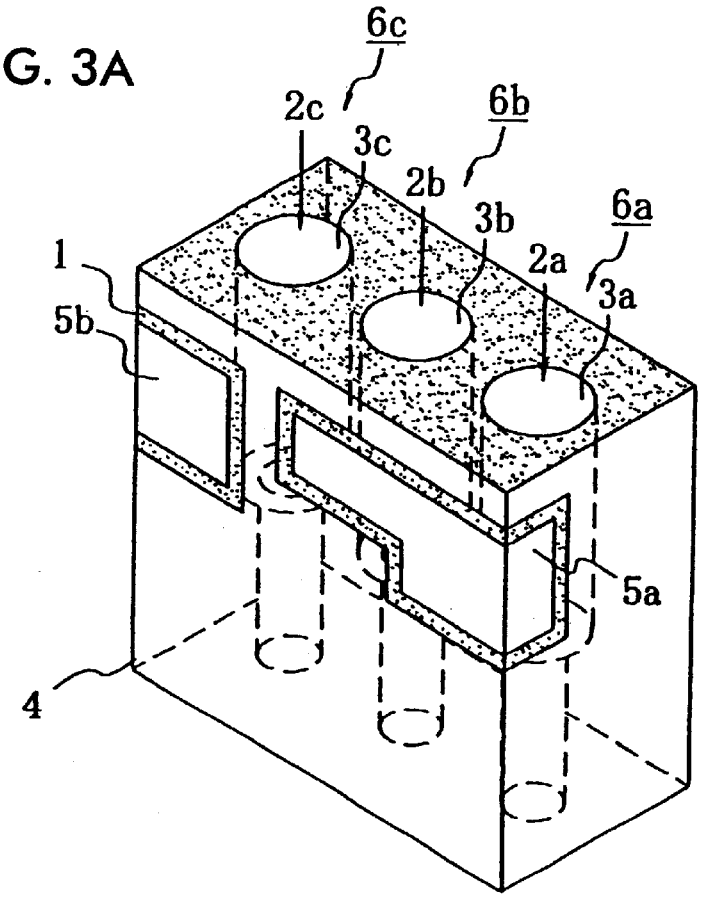
FIG. 3A is a perspective view of a dielectric filter according to a second embodiment.
Figure 3B:
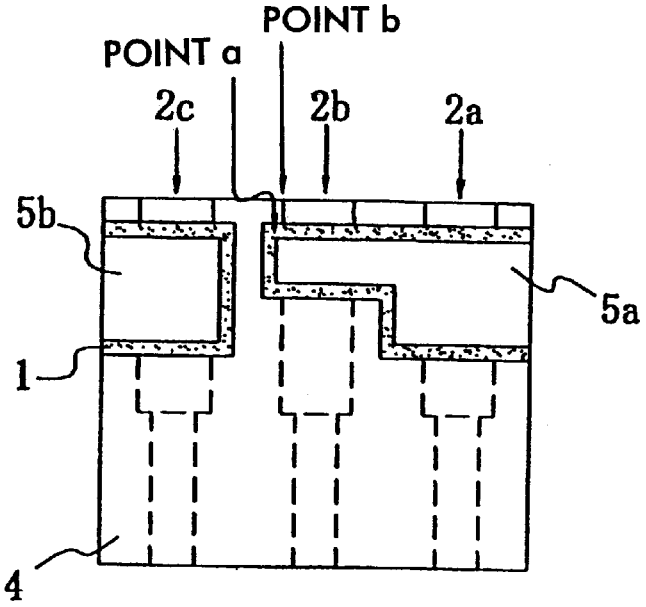
FIG. 3B is an elevational view of the dielectric filter according to the second embodiment.

FIG. 3A is a perspective view of a dielectric filter, while FIG. 3B is an elevational view of the same.

Figure 4A:
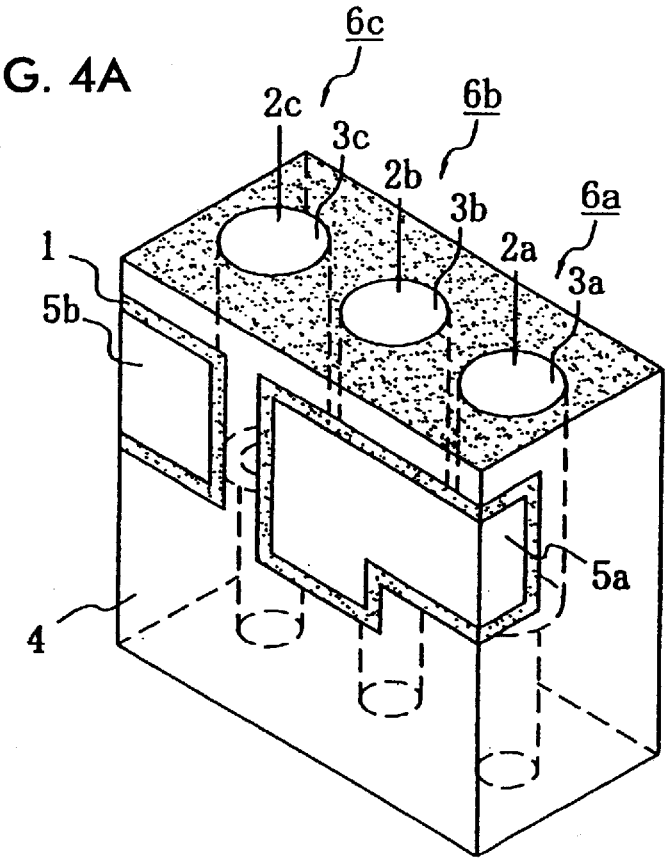
FIG. 4A is a perspective view of another dielectric filter according to the second embodiment.
Figure 4B:
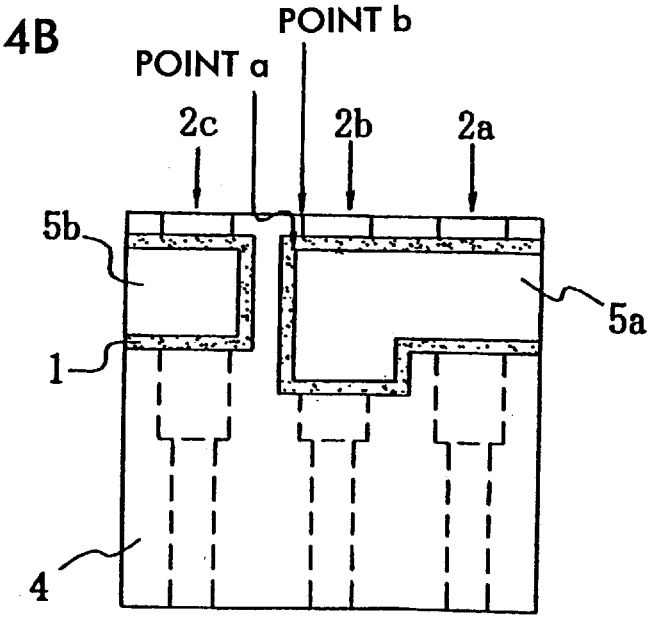
FIG. 4B is an elevational view of the other dielectric filter according to the second embodiment.

FIG. 4A is a perspective view of another dielectric filter, while FIG. 4B is an elevational view of the same.

In FIGS. 3A and 3B and FIGS. 4A and 4B, the dielectric filter includes a dielectric block 1, inner-conductor holes 2*a*, 2*b* and 2*c*, inner conductors 3*a*, 3*b* and 3*c*, an outer conductor 4, I/O electrodes 5*a* and 5*b*, and dielectric resonators (hereinafter referred to as resonators) 6*a*, 6*b* and 6*c*.

The dielectric filter shown in FIGS. 3A and 3B is formed in the same manner as in the first embodiment, except that the shape of the I/O electrode 5*a* is modified.

As shown in FIG. 3B, the side-surfaces of the dielectric block 1 are orthogonal to the direction in which the inner-conductor holes 2*a* to 2*c* are arrayed. A point a corresponds to a position beyond a side of the inner-conductor hole 2*b*, that is, the side near the inner-conductor hole 2*c*. A point b corresponds to a side of the inner-conductor hole 2*b*, that is, the side near the inner-conductor hole 2*c*. The I/O electrode 5*a* extends from one side-surface near the inner-conductor hole 2*a* to the point a. The width of the I/O electrode 5*a*, which is parallel to the axial direction of the inner-conductor holes, is smaller at the region where it is coupled with the resonator 6*b* than at the region where it is coupled with the resonator 6*a*.

A dielectric filter shown in FIG. 4A is formed in the same manner as in the first embodiment, except that the shape of the I/O electrode 5*a* is modified. That is to say, the width of the I/O electrode 5*a* at a region where it is coupled with the resonator 6*b* is larger than at the region where it is coupled with the resonator 6*a*.

According to the above-described configurations, the position of an attenuation pole may be changed by changing the coupling capacitance between the resonator 6*b* and the I/O electrode 5*a*. Subsequently, the dielectric filter readily and stably exhibits the desired characteristics.

Further, when the width of the I/O electrode 5*a* at the region where the resonator 6*b* is connected is narrow, the following effects may be obtained. That is to say, when the I/O electrode 5*a* becomes long enough to cover the resonator 6*a* and the resonator 6*b*, the coupling capacitance obtained becomes much larger than desired. By making the width of the I/O electrode 5*a* at the region where the resonator 6*b* is coupled narrow as shown in FIGS. 3A and 3B, the coupling capacitance can be reduced to a desired level.

Although the coupling capacitance can also be adjusted by making the I/O electrode 5*a* shorter, the change resulting from this method becomes too large. In other words, it is very difficult to achieve fine adjustments simply by making the I/O electrode 5*a* shorter. However, by adjusting the width of the I/O electrode 5*a* at the region where it covers the inner-conductor holes as in this embodiment, it is easy to make fine adjustments and to reduce the coupling capacitance to a desired level.

One surface of each of the dielectric filters described in the first and the second embodiments has one of the openings of each of the inner-conductor holes 2*a* to 2*c* but no electrodes thereon. Thus, this surface functions as an open end of the dielectric filters. However, other types of dielectric filter according to the present invention are possible. For example, one type of dielectric filter may comprise, on a surface having one of the openings of each inner-conductor hole, coupling electrodes for generating capacitance between the openings of neighboring inner-conductor holes. Another type of dielectric filter may comprise an outer conductor formed on all surfaces of the dielectric block, and, near one of the surfaces which has one of the openings of each inner-conductor hole, each of the inner-conductor holes may have a region where no inner conductor is formed, these regions being provided near said openings of the inner-conductor holes. In this way, the regions of the inner-conductor holes where no conductor is formed function as open ends of the dielectric resonators.

The sectional shape of the inner-conductor holes is not limited to a circle, but may be an ellipse, a polygon and so forth.

A dielectric duplexer according to a third embodiment will now be described with reference to FIG. 5A and FIG. 5B.

Figure 5A:
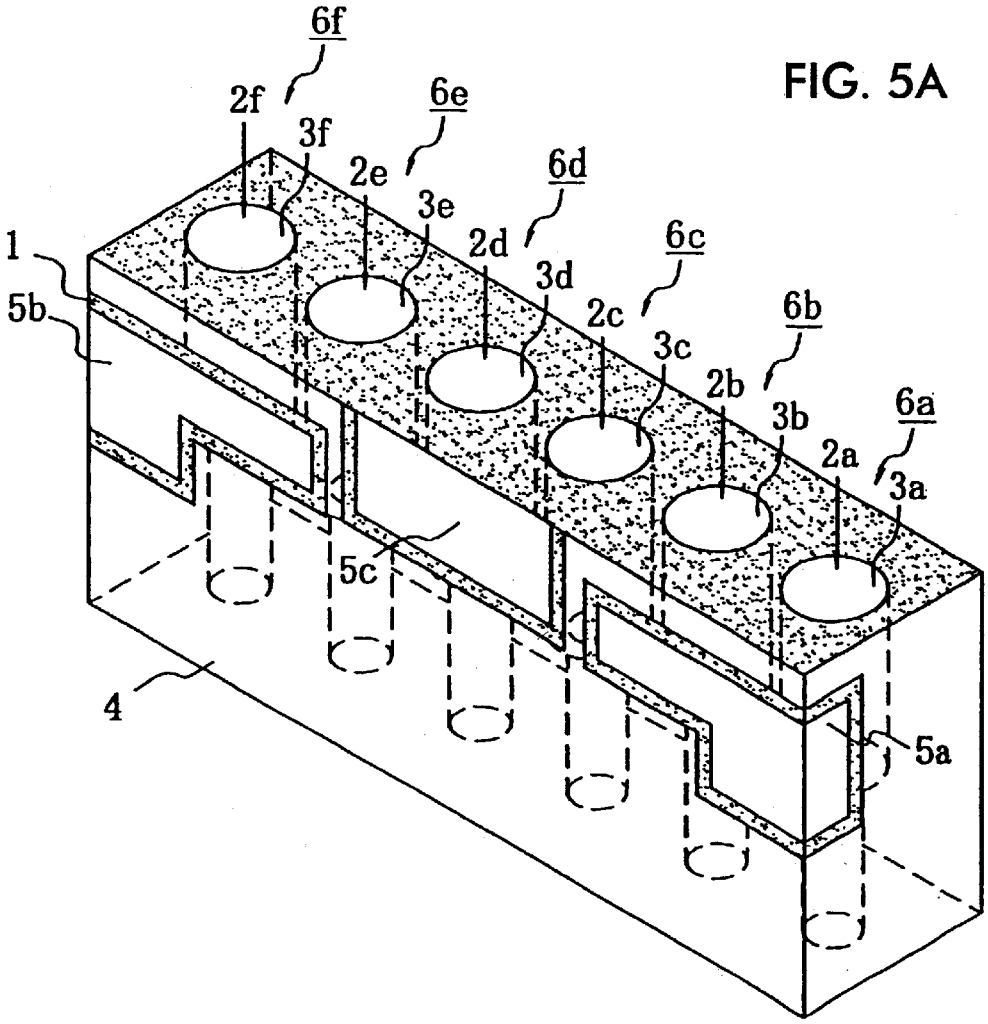
FIG. 5A is a perspective view of a dielectric duplexer according to a third embodiment.
Figure 5B:
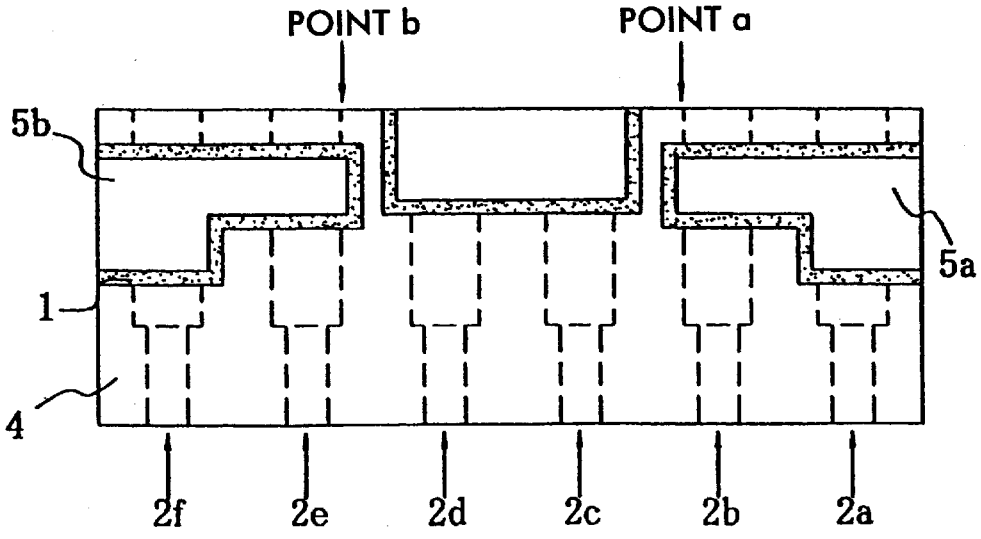
FIG. 5B is an elevational view of the dielectric duplexer according to the third embodiment.

FIG. 5A is a perspective view of the dielectric duplexer, and FIG. 5B is an elevational view of the same.

In FIGS. 5A and 5B, the dielectric duplexer includes a dielectric block 1, inner-conductor holes 2*a*, 2*b*, 2*c*, 2*d*, 2*e*, and 2*f*, inner conductors 3*a*, 3*b*, 3*c*, 3*d*, 3*e*, and 3*f*, an outer conductor 4, I/O electrodes 5*a*, 5*b* and 5*c*, and dielectric resonators (hereinafter referred to as resonators) 6*a*, 6*b*, 6*c*, 6*d*, 6*e*, and 6*f*.

Inside the dielectric block 1, the inner-conductor holes 2*a* to 2*f*, having the inner conductors 3*a* to 3*f* formed on the surfaces thereof, form resonator electrodes. On the outer surface of the dielectric block 1, the outer conductor 4 forms a ground electrode. In this manner, the inner-conductor holes 2*a* to 2*f* and the outer electrode 4 constitute the dielectric resonators 6*a* to 6*f*. The I/O electrode 5*a* extends from one side-surface to the undersurface of the dielectric block 1 and is separated from the outer conductor 4. The side-surfaces are orthogonal to the direction in which the inner-conductor holes are arrayed, and the undersurface faces a mounting substrate (not shown) when the duplexer is mounted. The I/O electrode 5*b* extends from the other side-surface to the undersurface of the dielectric block 1 and is separated from the outer conductor 4. The I/O electrode 5*c* is formed only on the undersurface, so as to couple with the resonators 6*c* and 6*d*.

In this embodiment, the resonators 6*a* to 6*f* are arrayed so that the resonator 6*b* is positioned to the left of the resonator 6*a*, the resonator 6*c* is positioned to the left of the resonator 6*b*, the resonator 6*d* is positioned to the left of the resonator 6*c*, the resonator 6*e* is positioned to the left of the resonator 6*d*, and the resonator 6*f* is positioned to the left of the resonator 6*e*, when viewed from the undersurface as shown in FIGS. 5A and 5B. Further, as shown in FIG. 5B, a point a corresponds to a side of the inner-conductor hole 2*b*, that is, the side near the inner conductor 2*c*, and a point b corresponds to a side of the inner-conductor hole 2*e*, that is, the side near the inner-conductor hole 2*d*.

The I/O electrode 5*a* on the undersurface extends from one side-surface to beyond the point a. The width of the I/O electrode 5*a* is smaller at the region where it is coupled with the resonator 6*b* than at the region where it is coupled with the resonator 6*a*. The width is parallel to the axes of the inner-conductor holes.

The I/O electrode 5*b* extends from the other side-surface to beyond the point b. The width of the I/O electrode 5*b* is smaller at the region where it is coupled with the resonator 6*e* than at the region where it is coupled with the resonator 6*f*. The width is parallel to the axes of the inner-conductor holes.

Thus, the dielectric duplexer comprises a dielectric block which has a dielectric filter having the resonators 6*a* and 6*b* coupled with the I/O electrode 5*a*, and the resonator 6*c* coupled with the I/O electrode 5*c*. The dielectric filter also has another dielectric filter having the resonators 6*e* and 6*f* coupled with the I/O electrodes 5*b*, and the resonator 6*d* coupled with the I/O electrode 5C.

Accordingly, the resulting dielectric duplexer exhibits desired characteristics, and suitable attenuation characteristics and stable communication characteristics are achieved.

As in the cases of the above-described dielectric filters, the dielectric duplexer may have an open end at a surface having one of the openings of each of the inner-conductor holes, and coupling electrodes on that surface. The duplexer may also be provided with an open end by providing a region where no inner conductor is formed on the surface of each of the inner-conductor holes.

Further, the sectional shape of the inner-conductor holes is not limited to a circle, but may be an ellipse, a polygon and so forth.

The configuration of a communication device according to a fourth embodiment will now be described with reference to FIG. 6.

Figure 6:
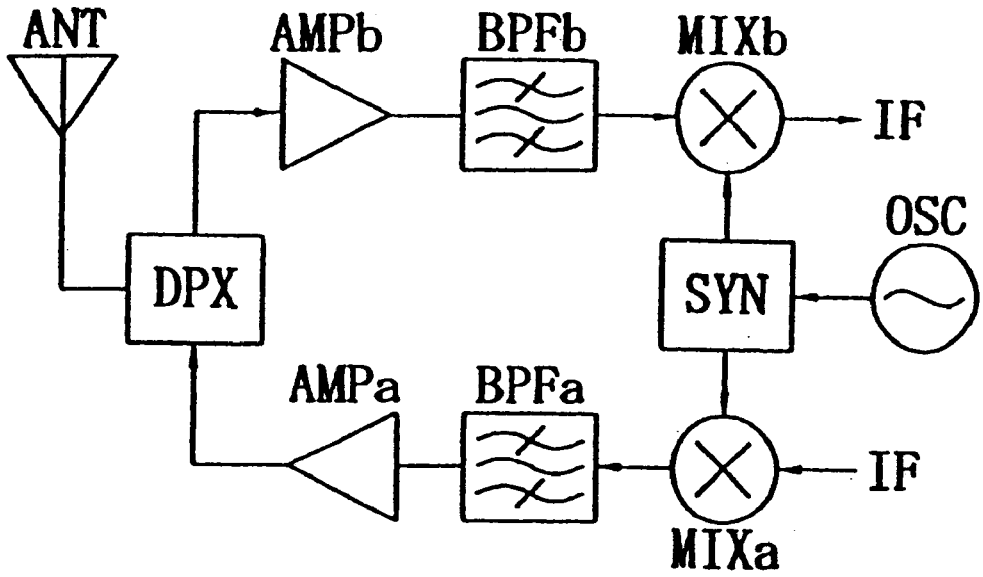
FIG. 6 is a block diagram of a communication device according to a fourth embodiment.

In FIG. 6, ANT denotes a transmission/reception antenna, DPX denotes a duplexer, BPFa and BPFb denote bandpass filters, AMPa and AMPb denote amplifier circuits, MIXa and MIXb denote mixers, OSC denotes an oscillator, SYN denotes a synthesizer, and IF denotes an intermediate frequency signal.

As the bandpass filters BPFa and BPFb shown in FIG. 6, the dielectric filters shown in FIGS. 1A and 1B, FIGS. 3A and 3B, and FIGS. 4A and 4B may be used. As the duplexer DPX shown in FIG. 6, the dielectric duplexer shown in FIGS. 5A and 5B may be used. The communication device offers predetermined communication performance by comprising the dielectric filters and the dielectric duplexer having desired characteristics for achieving suitable and stable attenuation.

Although the present invention has been described in relation to particular embodiments thereof, many other variations and modifications and other uses will become apparent to those skilled in the art. Therefore, the present invention is not limited by the specific disclosure herein.

What is claimed is:

1. A dielectric filter comprising:

a substantially rectangular parallelepiped dielectric block;

a plurality of inner-conductor holes extending from a top surface to an opposing bottom surface of the dielectric block;

an inner conductor provided on the respective surface of each of the inner-conductor holes;

an outer conductor formed on outer surfaces of the dielectric block; and

I/O electrodes extending from side-surfaces to an undersurface of the dielectric block, the side-surfaces being orthogonal to a direction in which the inner-conductor holes are arrayed in the dielectric block, and the undersurface being a mounting surface for being mounted on a mounting board, wherein the I/O electrodes are separated from the outer conductor and provide capacitance between the I/O electrodes and the plurality of inner-conductor holes, at least one of the I/O electrodes extends onto the undersurface of the dielectric block so as to overlie at least two of the inner-conductor holes when viewed from the undersurface, and further extends from the corresponding side-surface to a point beyond the second one of the at least two inner-conductor holes in a direction away from the corresponding side-surface for providing the capacitance stability between the second one of the at least two inner-conductor holes and the at least one of the I/O electrodes; and wherein a first one and a second one of the at least two inner-conductor holes are capacitively coupled to each other.

2. A dielectric filter according to claim 1, wherein the at least one of the I/O electrodes has a width which is different between a first region corresponding to the first one of the at least two inner-conductor holes and a second region corresponding to the second one of the at least two inner-conductor holes when viewed from the undersurface.

3. A dielectric filter according to claim 2, wherein the width at the first region is larger than the width at the second region.

4.A dielectric filter according to claim 2, wherein the width at the first region is smaller than the width at the second region.

5. A dielectric duplexer comprising:

a pair of dielectric filters, one of said filters being a dielectric filter comprising:

a substantially rectangular parallelepiped dielectric block;

a plurality of inner-conductor holes extending from a top surface to an opposing bottom surface of the dielectric block;

an inner conductor provided on the respective surface of each of the inner-conductor holes;

an outer conductor formed on outer surfaces of the dielectric block; and

I/O electrodes extending from side-surfaces to an undersurface of the dielectric block, the side-surfaces being orthogonal to a direction in which the inner-conductor holes are arrayed in the dielectric block, and the undersurface being a mounting surface for being mounted on a mounting board, wherein the I/O electrodes are separated from the outer conductor and provide capacitance between the I/O electrodes and the plurality of inner-conductor holes, at least one of the I/O electrodes extends onto the undersurface of the dielectric block so as to overlie at least two of the inner-conductor holes when viewed from the undersurface, and further extends from the corresponding side-surface to a point beyond the second one of the at least two inner-conductor holes in a direction away from the corresponding side-surface for providing the capacitance stability between the second one of the at least two inner-conductor holes and the at least one of the I/O electrodes; and wherein a first one and a second one of the at least two inner-conductor holes are capacitively coupled to each other.

6. A communication device comprising at least one of a transmitting circuit and a receiving circuit, the at least one circuit comprising a dielectric filter as described in claim 1.

7. A dielectric filter according to claim 1, wherein the outer conductor is formed on all of the outer surfaces of the dielectric block except the top surface.

8. A dielectric filter according to claim 7, wherein the inner conductors are connected to the outer conductor at the bottom surface.

9. A dielectric filter according to claim 2, wherein the second region extends to a point beyond the second one of the at least two inner conductor holes in a direction away from the corresponding side-surface.

10. A dielectric filter comprising:

a substantially rectangular parallelepiped dielectric block;

a plurality of inner-conductor holes extending from a top surface to an opposing bottom surface of the dielectric block;

an inner conductor provided on the respective surface of each of the inner-conductor holes;

an outer conductor formed on outer surfaces of the dielectric block; and

I/O electrodes extending from side-surfaces to an undersurface of the dielectric block, the side-surfaces being orthogonal to a direction in which the inner-conductor holes are arrayed in the dielectric block, and the undersurface being a mounting surface for being mounted on a mounting board, wherein the I/O electrodes are separated from the outer conductor and provide capacitance between the I/O electrodes and the plurality of inner-conductor holes, at least one of the I/O electrodes is disposed in such a position on the undersurface of the dielectric block as to couple to at least two of the inner-conductor holes, and extends from the corresponding side-surface to a point beyond the second one of the at least two inner-conductor holes in a direction away from the corresponding side-surface for providing the capacitance stability between the second one of the at least two inner-conductor holes and the at least one of the I/O electrodes; and wherein a first one and a second one of the at least two inner-conductor holes are capacitively coupled to each other.

11. A dielectric filter according to claim 10, wherein the at least one of the I/O electrodes has a width which is different between a first region corresponding to the first one of the at least two inner-conductor holes and a second region corresponding to the second one of the at least two inner-conductor holes when viewed from the undersurface.

12. A dielectric filter according to claim 11, wherein the second region extends to a point beyond the second one of the at least two inner conductor holes in a direction away from the corresponding side-surface.

13. A dielectric filter according to claim 11, wherein the width at the first region is larger than the width at the second region.

14. A dielectric filter according to claim 11, wherein the width at the first region is smaller than the width at the second region.

* * * * *